US005934523A

United States Patent [19]

Willett et al.

[11] Patent Number: 5,934,523

[45] Date of Patent: Aug. 10, 1999

[54] UNIVERSAL AUTOMATIC LONG SLEEVE FOLDING DEVICE

[75] Inventors: Richard A. Willett, Loganville; Keith D. Cooper, Monticello, both of Ga.

[73] Assignee: Southland Equipment Company, Inc., Covington, Ga.

[21] Appl. No.: 08/895,506

[22] Filed: Jul. 16, 1997

[51] Int. Cl.[6] ..... A41H 33/00; B65G 15/12

[52] U.S. Cl. ..... 223/37; 198/626.1; 198/604

[58] Field of Search ..... 223/37, 38; 198/626.1, 198/604

[56] References Cited

U.S. PATENT DOCUMENTS

| | | | |
|---|---|---|---|
| 2,122,052 | 6/1938 | Bell | 493/624 |
| 3,419,199 | 12/1968 | Lornitzo . | |
| 3,477,619 | 11/1969 | Lee . | |
| 3,828,989 | 8/1974 | Heater | 223/37 |
| 3,869,073 | 3/1975 | Knappe et al. . | |
| 3,884,402 | 5/1975 | Knappe et al. . | |
| 3,904,090 | 9/1975 | Kanneglesser et al. . | |
| 3,912,136 | 10/1975 | Nolte . | |
| 4,026,444 | 5/1977 | Harjapaa . | |
| 4,222,507 | 9/1980 | Bengtsson et al. . | |
| 4,277,005 | 7/1981 | Heap . | |
| 4,391,394 | 7/1983 | Hoffmann . | |
| 4,739,910 | 4/1988 | Westphal et al. | 223/37 |
| 4,889,264 | 12/1989 | Huang . | |
| 4,982,676 | 1/1991 | Moril et al. . | |
| 5,037,369 | 8/1991 | Keeton | 493/444 |
| 5,074,444 | 12/1991 | Cooper . | |
| 5,108,017 | 4/1992 | Adamski, Jr. et al. . | |
| 5,417,351 | 5/1995 | Grosz . | |

FOREIGN PATENT DOCUMENTS

| | | | |
|---|---|---|---|
| 2424354 | 12/1979 | France | 223/37 |

*Primary Examiner*—Bibhu Mohanty
*Attorney, Agent, or Firm*—Hinkle & Associates, P.C.

[57] ABSTRACT

A universal automatic long sleeve folding device (10) has a forming plate (20) for carrying a garment (12) spaced vertically above a movable lower product conveyer (54). A movable fold drive belt (34) is vertically displaced above the forming plate to move the garment across the forming plate. The fold drive belt and the lower product conveyor rotate at the same speed. Tucker arm assemblies (88) are disposed on opposite sides of the forming plate to engage the long sleeves (14) of the garment and tuck the long sleeves into a space between the forming plate and the lower product conveyor as the garment moves across the forming plate. The tucked long sleeves are carried by the lower product conveyor.

38 Claims, 6 Drawing Sheets

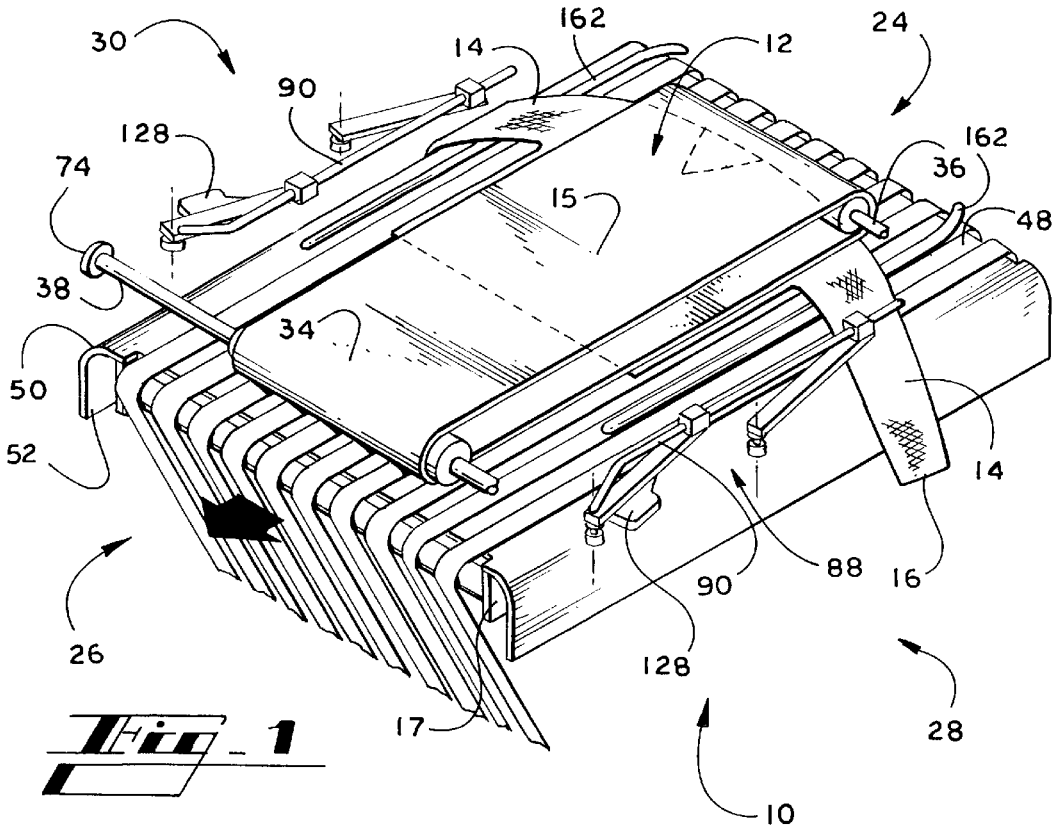
Fig_1
Fig_2
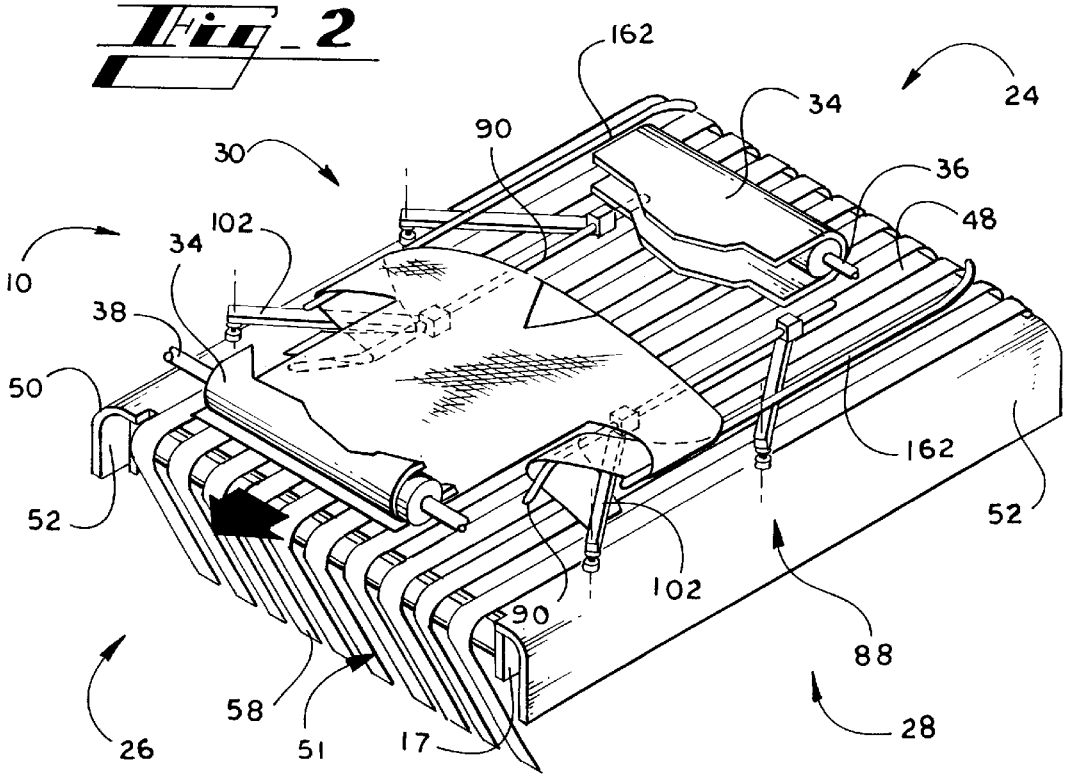

UNIVERSAL AUTOMATIC LONG SLEEVE FOLDING DEVICE

BACKGROUND OF THE INVENTION

I. Field of the Invention.

The present invention relates generally to the field of garment folding devices. More particularly, the present invention relates to a device which automatically folds long sleeves of a garment while simultaneously feeding the garment to a body folding device.

II. Description of the Related Art.

Generally, in the garment industry it is desirable to fold garments so that they can be more easily packaged for shipment from the manufacture. However, the folding of long sleeve garments, such as shirts, sweatshirts and jerseys, is particularly bothersome. This is due mostly to the awkward presence of the long sleeves which present added bulk when folded and which represent a problem for prior art automatic folding machines. Although there are machines which can fold the long sleeves of long sleeve garments, they are relatively slow and do not continuously move the garment through the machine in a non-stop fashion. Due to the inefficiency of the prior art machines, it is still common for a human operator to hand-fold the sleeves behind the torso prior to placing the shirt on a folding tray of an automatic shirt torso folding machine. This is time consuming as well as inconsistent in sleeve placement; and furthermore, most hand-fold methods result in an unacceptably bulky accumulation of sleeve material.

Lornitzo in U.S. Pat. No. 3,419,199 describes a shirt-folding machine and method. This machine has a set of sleeve-folding arms which are disposed in respective clearance positions so that the long sleeves of the shirt may be draped in the path of movement of the arms. The arms move one after the other in sweeping arcuate paths to carry the long sleeves upwardly to contact the shirt torso. The arms remain in contact with the long sleeves while the remainder of the shirt is folded.

In U.S. Pat. No. 3,477,619, Lee describes an automatic shirt folding machine. To fold the long sleeves of a garment, this device first secures and partially folds the shirt torso. A pair of arms are pivotally mounted to the machine, one on each side. Extending from each of the arms are a pair of spaced apart rods. The long sleeve is manually draped over the upper most rod and hangs below the other rod. As each arm pivots, one after the other, the upper most rod carries the long sleeve toward the shirt torso. The other rod then pins and holds the long sleeve in contact with the shirt torso while the remainder of the shirt torso is folded.

In U.S. Pat. No. 5,074,444 issued to Applicant Cooper describes a method and apparatus for folding a long sleeve shirt. This machine has a long sleeve folding section which is comprised of a pair of vertically spaced apart platforms and a pair of tucker rods. The platforms do not have belts or conveyers, and the shirt does not move in a continuous, non-stop manner through this section. Each of the tucker rods are respectively, pivotally mounted at one end thereof to a rotatable post. In operation, the garment is secured at its top portion to an upper platform surface by clamping fingers with the long sleeves hanging below the lower platform. One of the tucker rods elevates and then sweeps into the space between the platforms in a arcuate motion to carry one of the sleeves toward the lower portion of the garment. The other tucker rod then elevates and sweeps into the space in a like manner, carrying the other sleeve toward the lower portion of the garment. The sleeves together form a V-like appearance. The tucker rods pivot away from the platforms, and the platforms move together and carry the shirt to a receiving element of the next section of the machine.

SUMMARY OF THE INVENTION

In accordance with the present invention and the contemplated problems which have and continue to exist in this field, the objectives of this invention are to provide a universal automatic long sleeve folding device which folds long sleeves of garments in an improved manner.

Another object of the present invention to provide a device that is universally mateable with various machines that automatically fold a garment torso.

It is also an object of the present invention to automatically fold the long sleeves of the garment as the garment moves continuously through the device.

Still, it is another object of the present invention to provide a pair of tucker arms that move from a retracted position to a tucked position with the tucker arm remaining substantially parallel to a longitudinal axis of a forming plate.

Yet, it is another object of the present invention to fold long sleeves of a garment along a line that is substantially perpendicular to a longitudinal axis of a forming plate.

This invention accomplishes the above and other objectives and overcomes the disadvantages of the prior art by providing a universal automatic long sleeve folding device that is simple in design and construction, inexpensive to fabricate, and easy to use. The device is readily adaptable to any automatic garment folding apparatus which receives garments having prefolded sleeves. The device has a forming plate spaced above a movable lower product conveyer. A movable fold drive belt is vertically displaced above the forming plate to move the garment across the forming plate. The fold drive belt and the lower product conveyor move at the same speed. Tucker arms tuck the long sleeves of the garment into a space between the forming plate and the lower product conveyor as the garment moves across the forming, plate. The tucked long sleeves are carried by the lower product conveyor.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing the preferred embodiment of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein:

FIG. 1 is perspective view of an automatic long sleeve folding device made in accordance with this invention with a garment having long sleeves placed thereon;

FIG. 2 is a perspective view of the automatic long sleeve folding device of FIG. 1 with the long sleeves of the garment being tucked below the garment;

Figure 7:
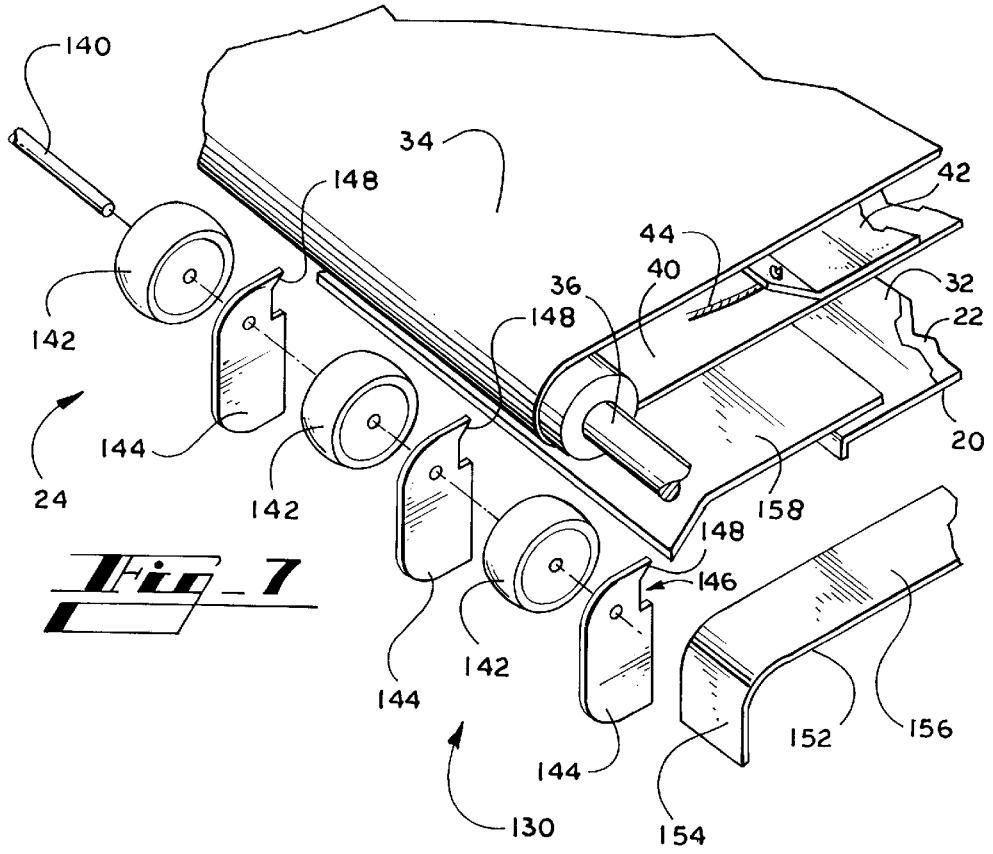
FIG. 7 is a perspective, exploded view of a portion of the front yoke assembly.

The reference numbers in the drawings relate to the following:

10=automatic long sleeve folding device
12=garment
14=long sleeve of garment
15=torso of garment
16=cuff of long sleeve
17=frame
18=forming plate extension bar
20=forming plate
22=upper surface of forming plate
24=infeed end of forming plate
26=discharge end of forming plate
28=first side of forming plate
30=second side of forming plate
32=layer of friction reducing substance
34=fold drive belt
36=front fold drive axle
38=rear fold drive axle
40=inner surface of fold drive belt
42=weight tray
44=connector
46=lower platform
48=top surface of lower platform
50=outer edge of top surface
52=side wall of lower platform
54=lower product conveyor
56=sleeve carrying portion of lower product conveyor
58=conveyor belt
60=front conveyor axle
62=rear conveyor axle
64=lower product conveyor drive roller
66=ridge
68=drive motor
70=main drive chain
72=motor drive gear
74=fold drive belt gear
76=jack shaft
78=first jack shaft gear
80=second jack shaft gear
82=main chain tensioner
84=transfer chain
86=lower conveyer gear
88=tucker arm assembly
90=tucker arm
92=forward end of tucker arm
94=reward end of tucker arm
96=tucker arm bend
98=arm mount block
100=arm mount block bottom
102=tucker arm support
104=distal end of tucker arm support
106=proximal end of tucker arm support
108=post
110=upper end of post
112=lower end of post
114=activator arm
116=post end of activator arm
118=piston end of activator arm
120=top side of activator arm
122=bottom side of activator arm
124=piston
126=rod
128=cuff paddle
130=front yoke assembly
132=infeed yoke
134=front yoke end of infeed yoke
136=rear yoke end of infeed yoke
138=yoke side wall of infeed yoke
140=yoke shaft
142=infeed wheel
144=stripper plate
146=notch of stripper plate
148=stop of notch
150=pinch point pressure cylinder
152=yoke extension wing
154=wing shoulder
156=wing surface
158=bridge plate
160=lower sleeve guide plate
162=forming plate extension bar
164=curve of forming plate extension bar
166=extension bar bracket
168=slot of extension bar bracket
170=product blow down tube
172=orifice of product blow down tube
174=air system
176=pressure regulator
178=solenoid valve
180=plunger of piston
182=sleeve fold photo eye

DESCRIPTION OF THE PREFERRED EMBODIMENTS

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIGS. 1 and 2. FIGS. 1 and 2 of the drawings illustrate an universally adaptable automatic long sleeve folding device 10 which receives a garment 12 and pre-folds long sleeves 14 of the garment 12. The garment 12, shown in FIGS. 1 and 2 partially with hidden lines, is generally any typical upper-body garment having two long sleeves 14 and a torso 15 and is capable of receiving and maintaining a fold; and will be referred to throughout this specification as simply a "garment". The torso 15 of the garment 12 is shown with hidden lines. At the distal end of each long sleeve 14 is a cuff 16.

Referring additionally to FIGS. 3 through 7, the device 10 has a frame 17, an elongated forming plate extension bar 18 mounted to the frame 17 and an elongated forming plate 20, also called an upper platform, mounted to the forming plate extension bar 18. The forming plate 20 has a substantially planar upper surface 22 to receive the garment 12, an infeed end 24, a discharge end 26, a first side 28, a second side 30 and a longitudinal axis disposed between the infeed and discharge ends 24 and 26. Preferably, the forming plate 20 has a layer of a friction reducing substance 32, such as Teflon, coating the upper surface 22 to reduce friction along the forming plate 20 as the garment 14 slides along the forming plate 20 from the infeed end 24 to the discharge end 26.

Vertically displaced above and in movable contact with the forming plate 20 is a rotating fold drive belt 34. The fold drive belt 34 engages and slides the garment 14 along the forming plate 20. With reference to FIGS. 1 and 2, the fold drive belt 34 rotates in a clockwise manner so that the direction of movement is from the infeed end 24 to the discharge end 26 of the forming plate 20. The fold drive belt 34 rotates about a front fold drive axle 36 and a rear fold drive axle 38 at a predetermined speed. Although not shown, the front and rear fold drives axles 36 and 38 are adjustably and rotatably mounted to the frame 17 by axle mounting brackets (not shown), which enable the tension on the fold drive belt 34 to be adjustably increased or decreased. The fold drive belt 34 has an inner surface 40 which engages the front and rear fold drive axles 36 and 38.

As the speed of rotation of the fold drive belt 34 increases, the fold drive belt 34 has a tendency to oscillate, which can result in poor contact of the fold drive belt 34 with the garment 14. Referring now to FIGS. 5 through 8, a weight tray 42, having a pre-selected weight, is provided to prevent such oscillation and maintain the fold drive belt 34 in contact with the garment 14. As a result, the garment 14 moves along the forming plate 20 at substantially the same speed as the fold drive belt 34. The weight tray 42 is disposed between the front and rear fold drive axles 36 and 38 and slidingly engages and rides upon the inner surface 40 of the fold drive belt 34. A flexible connector 44, such as a cord, rope, or chain, operably connects the weight tray 42 to the frame 17.

Figure 6:
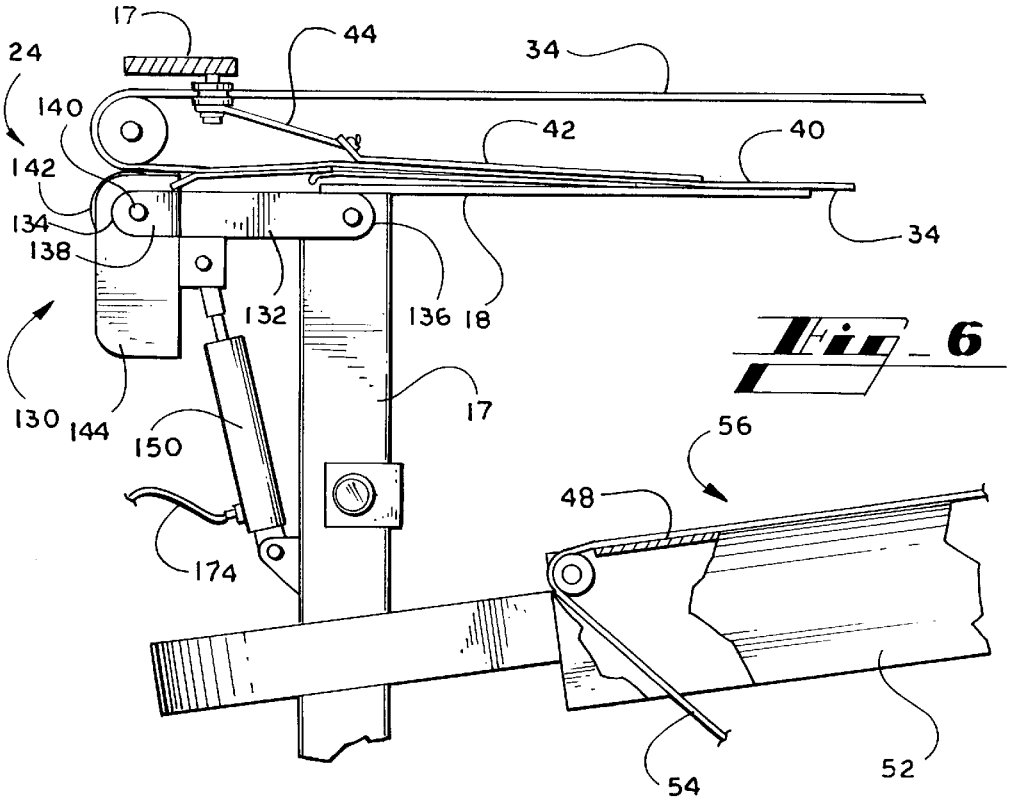
FIG. 6 is a side elevation view of a front yoke assembly.
Figure 4:
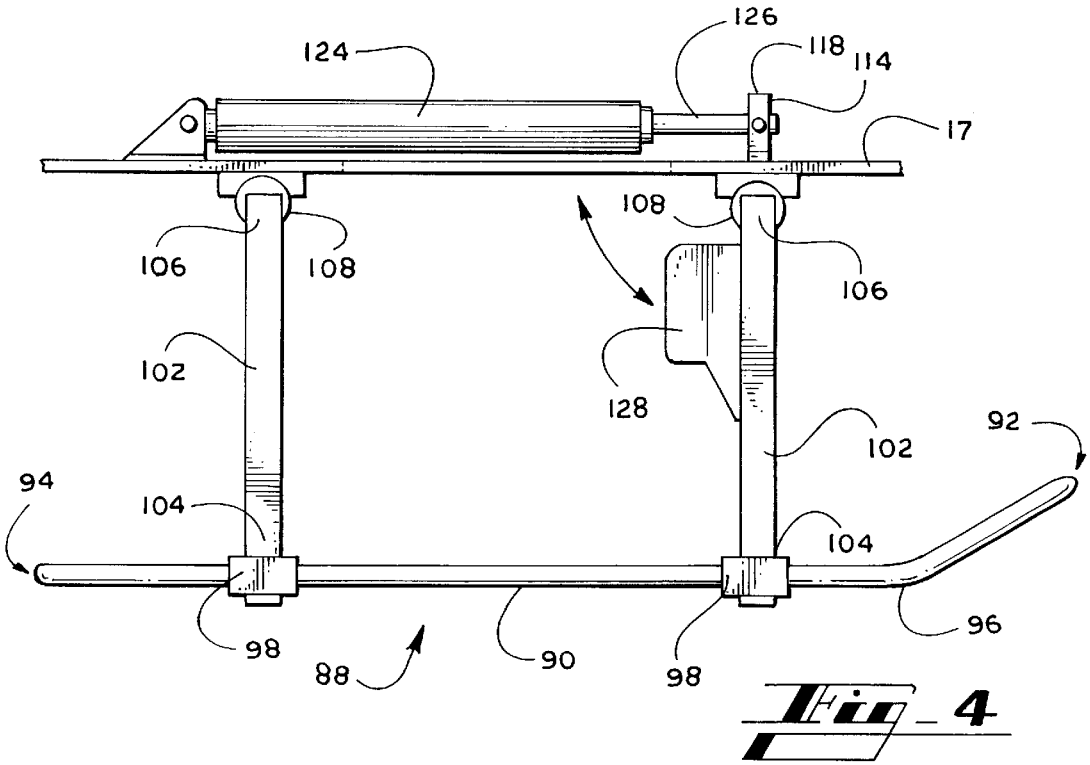
FIG. 4 is a top plan view of the tucker arm assembly of FIG. 3 in a tucked position.

Referring again to FIGS. 1, 2 and 5, a lower platform 46 is mounted to the frame 17 and vertically displaced between the forming plate extension bar 18 and a ground surface (not shown). The lower platform 46 has a substantially planar top surface 48, outer edges 50 substantially parallel to the longitudinal axis of the forming plate 20 and side walls 52 extending downwardly from outer edges 50 of the top surface 48. Preferably, the outer edges 50 are rounded, and the side walls 52 extend below the portion of the frame 17 supporting the lower platform 46 to prevent the long sleeves 14 from becoming entangled with the frame 17. As shown in FIG. 6, the distance between the upper surface 22 of the forming plate 20 and the top surface 48 of the lower platform 46 preferably decreases from the infeed end 24 to the discharge end 26. The separation between the lower platform 46 and the forming plate 20 defines a space. Additionally, the distance between the upper surface 22 of the forming plate 20 and the top surface 48 of the lower platform 46 is predetermined such that the long sleeve 14 hangs below the top surface 48 of the lower platform 46.

Figure 5:
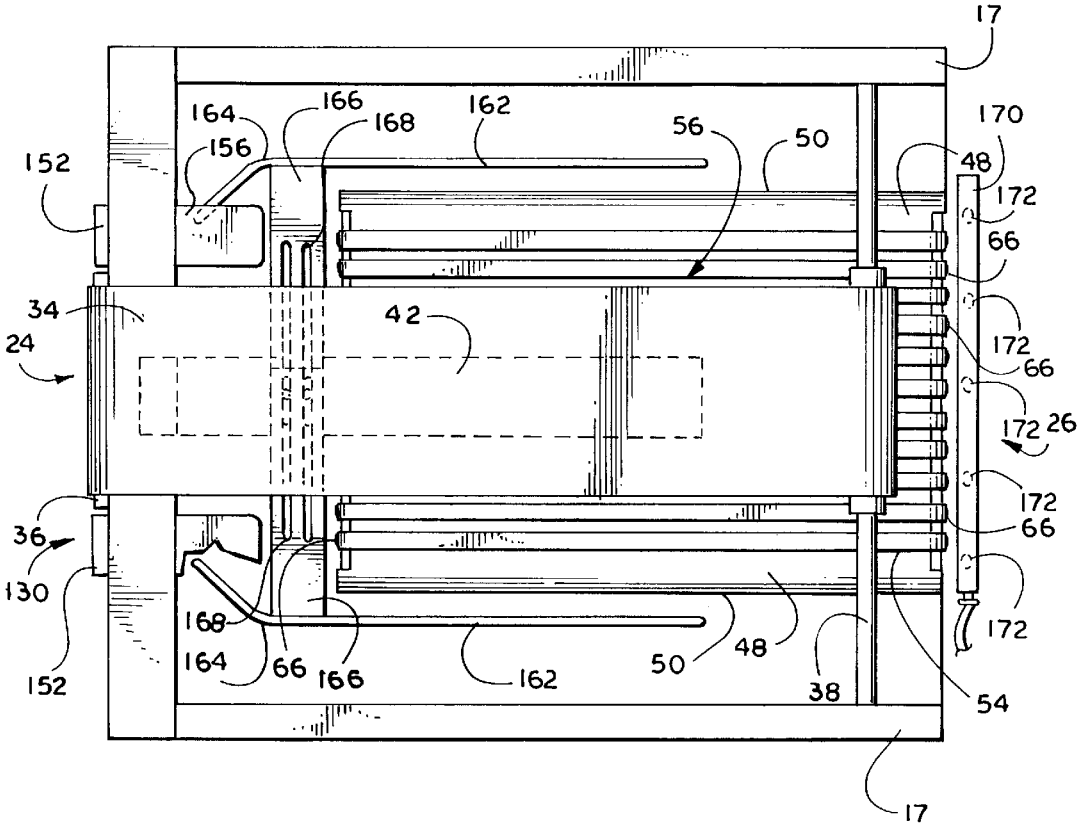
FIG. 5 is a top plan view of the device of FIG. 1.
Figure 8:
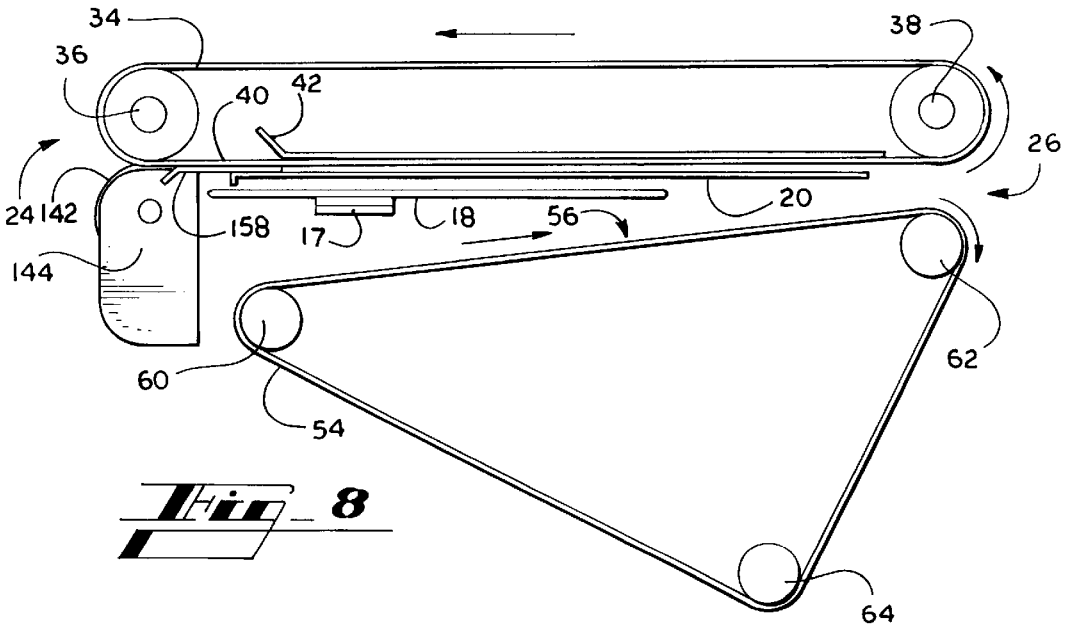
FIG. 8 is a side elevation view of a fold drive belt and a lower product conveyer.

FIGS. 1, 2, 5, 6 and 8 show a lower product conveyor 54 having a sleeve carrying portion 56 movably disposed across the top surface 48 of the lower platform 46. The lower product conveyor 54, preferably comprises a plurality of spaced-apart conveyor belts 58, engages and carries the long sleeves 14 of the garment 12 along the lower platform 46 in a direction from the infeed end 24 to the discharge end 26 of the forming plate 20. As shown in FIG. 8, the lower product conveyor 54 rotates about a front conveyor axle 60, a rear conveyor axle 62 and a lower product conveyor drive roller 64. The sleeve carrying portion 56 extends from the front conveyor axle 60 to the rear conveyor axle 62. Preferably, as shown in FIG. 5, the front and rear conveyor axles 60 and 62 and the lower product conveyor drive roller 64 have spaced-apart ridges 66 which receive the conveyor belts 58 and maintain the conveyor belts 58 in an alignment substantially parallel to the longitudinal axis of the forming plate 20. The speed of rotation of the lower product conveyor 54 about the front conveyor axle 60, the rear conveyor axle 62 and the lower product conveyor drive roller 64 is substantially the same as the speed of rotation of the fold drive belt 34.

Figure 9:
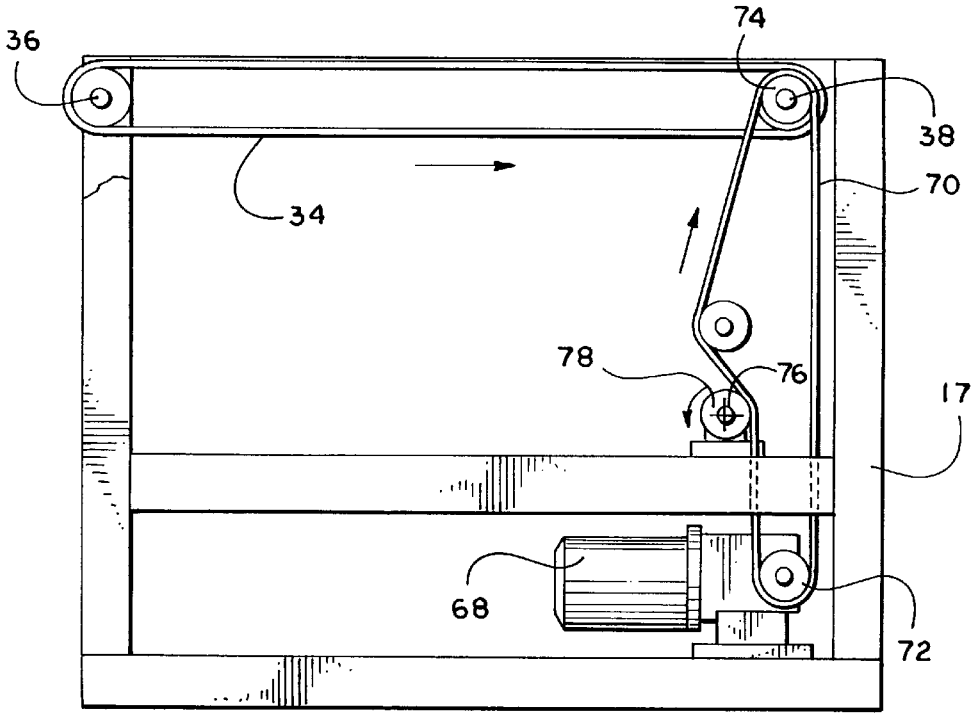
FIG. 9 is a side elevation view of a main drive chain.
Figure 10:
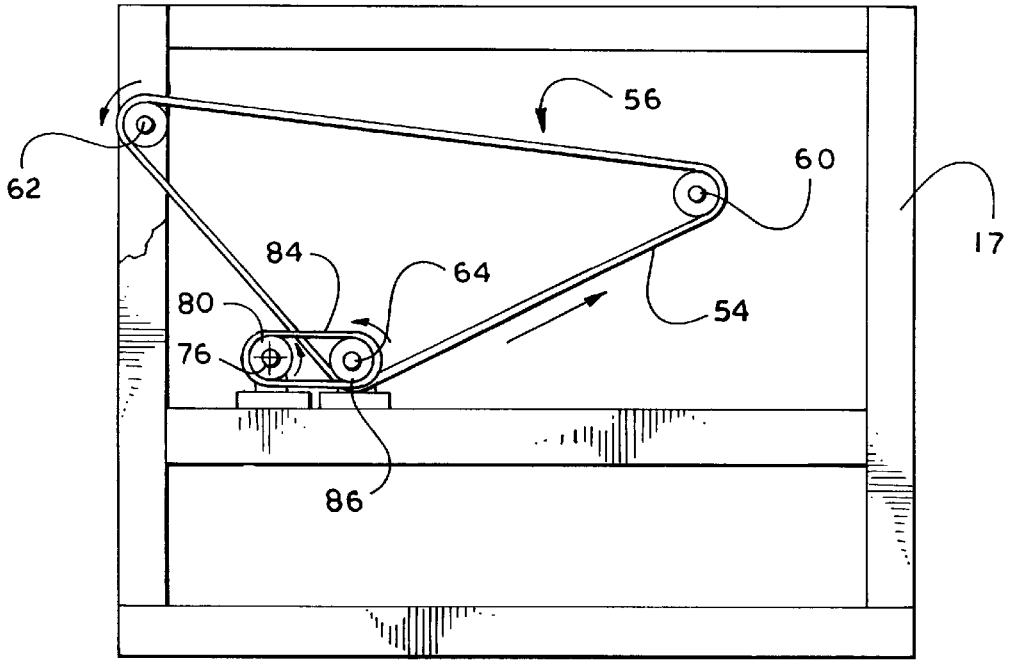
FIG. 10 is a side elevation view of a lower product conveyer drive.

With reference to FIGS. 1 and 2, the lower product conveyor 54 rotates in a counter clockwise manner so that the direction of movement from the infeed end 24 to the discharge end 26 of the forming plate 20 is the same as the fold drive belt 34. Referring now to FIGS. 9 and 10, the fold drive belt 34 and the lower product conveyor 54 are linked together and are driven by a drive motor 68, preferably an electric motor, which is mounted to the frame 17. The fold drive belt 34 and the lower product conveyor 54 are operably connected to the drive motor 68 by a main drive chain 70. Mounted to the motor drive shaft (not shown) is a motor drive gear 72. A fold drive belt gear 74 is mounted to the rear fold drive axle 38. The main drive chain 70 movably engages the motor drive gear 72 and the fold drive belt gear 74, enabling the drive motor 68 to rotate the fold drive belt 34. A jack shaft 76 is rotatably mounted to the frame 17 and transfers rotational energy to the lower product conveyor 54. Proximate one end of the jack shaft 76, near the drive motor 68, is a first jack shaft gear 78. A second jack shaft gear 80 is mounted to the jack shaft 76 proximate the other end thereof. As shown in FIG. 9, the main drive chain 70 engages the first jack shaft gear 78 such that the direction of rotation of the jack shaft 76 is opposite that of the direction of rotation of the rear fold drive axle 38. Because the main drive chain 70 is not looped around the first jack shaft gear 78, a main chain tensioner 82 is provided to retain the main drive chain 70 in contact with the first jack shaft gear 78. Referring again to FIG. 10, the second jack shaft gear 80 movably engages a transfer chain 84 which is operably connected to a lower conveyor gear 86. The lower conveyor gear 86 is mounted to the lower product conveyer drive roller 4.

Upon activation of the drive motor 68, the motor drive shaft rotates the motor drive gear 72, causing the main drive chain 70 to rotate the rear fold drive axle 38 in one direction and the jack shaft 76 in the opposite direction. The rotating rear fold drive axle 38 causes the fold drive belt 34 to rotate in the same direction as the rear fold drive axle 38. As the jack shaft 76 rotates, the transfer chain 84 engages the lower conveyor gear 86 and rotates the lower product conveyor drive roller 64. As a result the lower product conveyor 54 rotates at the same speed as the fold drive belt 34, but in the opposite direction, as shown in FIG. 8.

Figure 3:
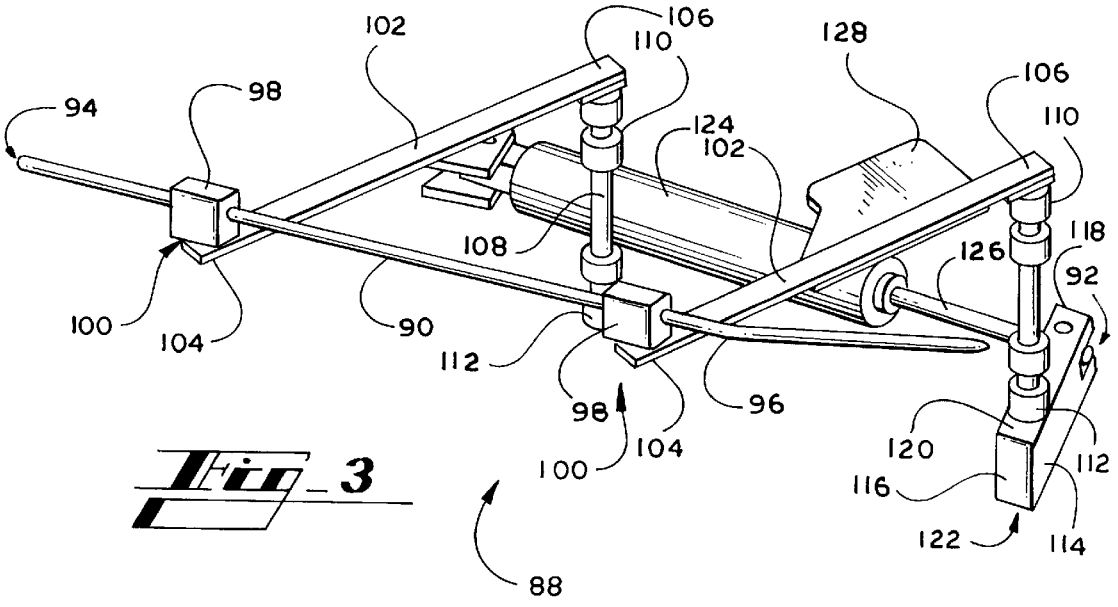
FIG. 3 is a perspective view of a tucker arm assembly.

Referring again to FIGS. 1 and 2, the long sleeves 14 of the garment 12 are tucked below the torso 15 by a pair of tucker arm assemblies 88. One tucker arm assembly 88 is disposed adjacent the first side 28 of the forming plate 20, and the other tucker arm assembly 88, which mirrors the tucker arm assembly 88 adjacent the first side 28, is disposed adjacent the second side 30 of the forming plate 20. With additional reference to FIGS. 3 and 4, the tucker arm assembly 88 has an elongated tucker arm 90 having a forward end 12, a rearward end 94 and bend 96 proximate the forward end 92. With respect to the ground surface, the rearward end 94 of the tucker arm 90 is preferably vertically displaced above the forward end 92. The bend 96 of the respective tucker arm 90 is outwardly oriented with respect to the longitudinal axis of the forming plate 20 to assist the tucker arm 90 in disengaging from the long sleeve 14. Mounted to each tucker arm 90 is a pair of spaced-apart arm mount blocks 98 having a mount block bottom 100. Each arm mount block 98 is pivotally mounted at the mount block bottom 100 to a respective tucker arm support 102 proximate a distal end 104 of the tucker arm support 102. At a proximal end 106 of each tucker arm support 102, the tucker arm support 102 is mounted to a post 108 at an upper end 110 of the post 108. Each post 108 has a lower end 112 opposite the upper end 110. The post 108 which is mounted to the tucker arm support 102 proximate the rearward end 94 of the tucker arm 90 is rotatably mounted to the frame 17 at the lower end 112. Movement of the tucker arm assembly 88 is accomplished by an activator arm 114 having a post end 16, a piston end 118, a top side 120 and a bottom side 122. The post 108, which is mounted to the tucker arm support 102 proximate the forward end 92 of the tucker arm 90, is mounted at the lower end 112 thereof to the activator arm 114 proximate the post end 116 on the top side 120. On the bottom side 122, the activator arm 114 is pivotally mounted to the frame 17 proximate the post end 116. The tucker arm assembly 88 is actuated by a bidirectional piston 124, which is mounted to the frame 17. A retractable rod 126 extends from the piston 124 and pivotally mounts to the activator arm 114 proximate the piston end 118. When the rod 126 is fully extended, as shown in FIG. 1, the tucker arm 90 is adjacent the piston 124 and defines a retracted position. As the rod 126 retracts into the piston 124, as shown in FIGS. 2 and 3, the activator arm 114 pivots and causes the tucker arm 90 to extend into the space between the forming plate 20 and the lower product conveyor 54. At the point where the rod 126 is fully retracted into the piston 124, the tucker arm 90 is fully extended into the space and defines a tucked position. It is preferable for the tucker arm 90 to be substantially parallel to the longitudinal axis of the forming plate 20 as the tucker arm 90 moves from the retracted position to the tucked position. It is also preferable for both tucker arm assemblies 88 to actuate from the retracted position to the tucked position simultaneously. A cuff paddle 128 is mounted to the tucker arm support 102 that is proximate the forward end 92 of the tucker arm 90 to prevent the cuff 16 of the long sleeve 14 from becoming entangled with this tucker arm support 102.

Detailed in FIGS. 5 through 7 is a front yoke assembly 130. The front yoke assembly 130 is provided to receive and feed the garment 12 to the infeed end 22 of the forming plate 20. Supporting the front yoke assembly 130 is a Y-shaped infeed yoke 132 having a front yoke end 134 and a rear yoke end 136. The rear yoke end 136 is pivotally mounted to the frame 17. A pair of spaced-apart yoke side walls 138 are at the front yoke end 134. A yoke shaft 140 extends from one yoke side wall 138 to the other yoke side wall 138 and is mounted thereto. Rotatably mounted on the yoke shaft 140 are a plurality of infeed wheels 142 which are maintained in separable contact with the fold drive belt 34 and define a pinch point. Pivotally mounted to the yoke shaft 140 are a plurality of stripper plates 144 having a notch 146. The stripper plates 144 and the infeed wheels 142 are disposed on the yoke shaft 140 in alternating fashion, as shown in FIG. 7. At the upper most portion of the notch 146 is a stop 148. The stop 148 limits the pivotal travel of the stripper plates 144 and is discussed further below. To maintain the infeed wheels 142 in separable contact with the fold drive belt 34, a pinch point pressure cylinder 150 is mounted at one end to the frame 17 and at the other end to the infeed yoke 132. The pinch point pressure cylinder 150 maintains a predetermined pressure on the infeed yoke 132 and allows the infeed yoke 132 to pivot away from the fold drive belt 34 as the garment 12 travels through the pinch point. Mounted to the frame 17 substantially parallel to the longitudinal axis of the forming plate 20 are a pair of spaced-apart elongated, L-shaped yoke extension wings 152. The yoke extension wings 152 have a wing shoulder 154 and a wing surface 156. A bridge plate 158 is mounted to the frame 17 and is disposed at one end in the notch 146. The other end of the bridge plate 158 extends over the infeed end 24 of the forming plate 20. As a garment 12 travels through the pinch point, the stripper plates 144 pivot and the stops 148 engage the bridge plate 158 to prevent the garment 12 from wrapping around the infeed wheels 142. Continuing through the pinch point, the garment slides across the bridge plate 158 onto the forming plate 20.

Referring to FIG. 5, a pair of spaced-apart lower sleeve guide plates 160 extend from the side wall 52 of the lower platform 46 to proximate the wing shoulder 154. The lower sleeve guide plates 160 are provided to keep the long sleeves 14 extended away from the front yoke assembly 130 as the garment 12 travels through the pinch point.

Again, referring to FIGS. 1, 2 and 5, a pair of elongated forming plate extension bars 162 are adjustably mounted to the frame 17. The forming plate extension bars 162 are disposed substantially parallel to the longitudinal axis of the forming plate 20 and have a curve 164 proximate the end of the forming plate extension bar 162 adjacent the front yoke assembly 130 to engage and direct the long sleeve 14 outwardly from the lower platform 46. As shown in FIG. 5, the curves 164 are directed toward one another. Each forming plate extension bar 162 has an extension bar bracket 166 extending substantially perpendicular therefrom. Because garments 12 have varying sizes and widths, the extension bar bracket 166 has at least one slot 168 to enable the respective forming plate extension bar 162 to be adjustably mounted to the frame 17 so that various sized garments 12 may be accommodated. A nut and bolt assembly (not shown) may be used to adjustably mount the forming plate extension bar 162 to the frame 17. Preferrably, the forming plate extension bars 162 slidingly engage the garment 12 at the intersection of the long sleeve 14 and the torso 15, as shown in FIGS. 1 and 2.

Continuing to refer to FIG. 5, a product blow down tube 170 is mounted to the frame 17 proximate and vertically spaced above the discharge end 26 of the forming plate 20. The product blow down tube 170 provides a blast of a clean stream of air, or other inert gas, through orifices 172 disposed along the product blow down tube 170. As the garment 12 is discharged from the forming plate 20, the air strikes and directs the garment 12 onto the lower product conveyor 54.

Figure 11:
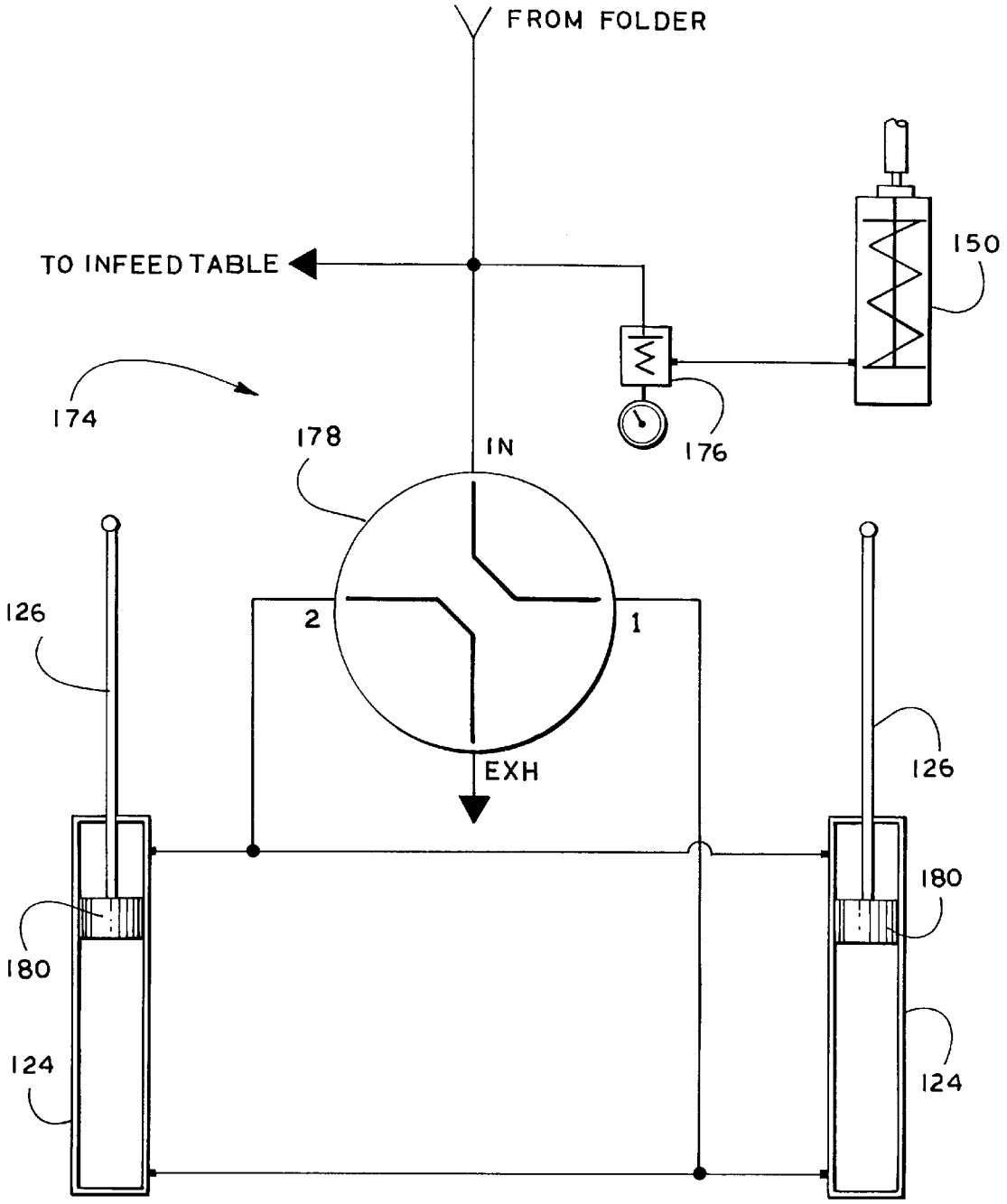
FIG. 11 is a schematic representation of the air actuation system.

Referring now to FIGS. 6 and 11, the device 10 is operated by a pressurized air system 174, with the exception of the drive motor 68. However, a motor driven by the air system 174 can be utilized in place of the drive motor 68. As shown in FIG. 11, the air system 174 is operably connected to the pinch point pressure cylinder 150, which performs similarly as a shock. The air system 174 provides the pressure needed to keep the front yoke assembly 130 in removable contact with the fold drive belt 34. If desired, an adjustable pressure regulator 176 can be disposed up stream of the pinch point pressure cylinder 150 to reduce the pressure of the air provided to the pinch point pressure cylinder 150. In this manner, the pressure applied to the front yoke assembly 130 is adjustable. A electrically activated solenoid valve 178 controls air flow to the piston 124. As shown in FIG. 11, the piston 124 has a plunger 180 disposed within the piston 124 and mounted to the rod 126. When the tucker arm 90 is the retracted position, the solenoid valve 178 directs air to a side of the plunger 180 to fully extend the rod 126. Likewise, when the tucker arm 90 is in the tucked position, the solenoid valve 178 directs air to a side of the plunger 180 to fully retract the rod 126. Detailed on FIG. 6 is a sleeve fold photo eye 182 that is operably connected to an adjustable timer (not shown). When the long sleeve 14 passes across the eye 182, the eye 182 activates the adjustable timer. After a first preselected period of time, the timer activates the solenoid valve 178 to direct air to the pistons 124 in a manner that the tucker arms 90 are preferrably simultaneously actuated into the tucked position. After a second preselected period of time, the timer activates the solenoid valve 178 to direct air to the pistons 124 in a manner that the tucker arms 90 are preferrably simultaneously actuated into the retracted position. Although not shown, the air system 174 can operably control an infeed table (not shown) having a platen surface (not shown) on which the garment 12 can be placed and fed to the pinch point.

In operation, the garment 12 is fed to the pinch point with the long sleeves 14 extending downwardly. As previously stated, this can be accomplished by placing the garment 12 on the platen surface and directing the torso 15 into the pinch point. As the garment 12 contacts the infeed wheels 142 and the fold drive belt 34, the fold drive belt 34 engages and draws the garment 12 through the pinch point. The garment 12 slides across the bridge plate 158 onto the forming plate 20 and the wing surfaces 154 of the yoke extension wings 152, keeping the torso 15 substantially planar. As the garment 12 moves across the forming plate, the long sleeves 14 slidingly engage the lower sleeve guide plates 160 to keep the long sleeves 14 extended away from the lower platform 46. As the torso 15 progresses away from the infeed end 24 of the forming plate 20, one of the long sleeves 14 is sensed by the sleeve fold photo eye 182 and activates the timer. The long sleeves 14, which extend below the top surface 48 of the lower platform 45, then slidingly engage the respective forming plate extension bars 162. The timer activates the tucker arm assemblies 88 to actuate such that the tucker arms 90 initially engage the respective long sleeves 14 between the forward end 92 and the bend 96. As the tucker arms 90 move to the tucked position, the long sleeves 14 continue to slide along the respective forming plate extension bars 162 proximate the intersections of the long sleeve 14 and the torso 15. The long sleeve 14 is then tucked into the space as the tucker arms 90 continue to move into the tucked position, and the portion of the long sleeve 14 proximate the cuff 16 then engages the lower product conveyor 54 to be carried by the sleeve carrying portion 56. When the tucker arms 90 are in the tucked position, the long sleeves 14 are tucked beneath the torso 15 toward one another along a line substantially perpendicular to the longitudinal axis of the forming plate 20. Each long sleeve 14 resultingly is folded on itself with a single fold proximate midway between the cuff 16 and the intersection of the long sleeve 14 and the torso 15. The long sleeves 14 continue to move along the lower product conveyor 54 and disengages from the tucker arm 90. The timer is timed to then direct actuation of the tucker arms 90 from the tucked position to the retracted position after the tucker arm 90 disengages the long sleeves 14. As the torso 15 is discharged from the forming plate, the product blow down tube 170 directs the torso onto the lower product conveyor 54 and onto the folded long sleeves 14. The garment 12 can then be fed to a device which automatically folds the torso 15 of the garment 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

Various modifications may be made of the invention without departing from the scope thereof and it is desired, therefore, that only such limitations shall be placed thereon as are imposed by the prior art and which are set forth in the appended claims.

What is claimed is:

1. A device for folding long sleeves of a long sleeve garment, the garment having a torso, the device comprising:

a lower platform raised above a ground surface;

an upper platform for supporting the long sleeve garment thereon with at least one of the sleeves of the garment hanging down below the lower platform, the upper platform being vertically displaced above the lower platform defining a space between the upper and lower platforms, the upper platform having an infeed end and a discharge end;

means for tucking a hanging-down sleeve into the space; and means for continuously moving the garment across the upper platform from the infeed end to the discharge end while the sleeve is being tucked beneath the garment torso.

2. A device as claimed in claim 1, wherein the tucking means includes means for tucking two hanging-down sleeves between the lower platform and the upper platform.

3. A device as claimed in claim 2, wherein the tucking means comprises means for simultaneously tucking the long sleeves between the lower platform and the upper platform.

4. A device as claimed in claim 1, wherein the upper platform is so constructed to engage a portion of a garment torso of predefined width, thereby predefining the amount of sleeve which is capable of being tucked between the lower and upper platforms.

5. A device as claimed in claim 1, wherein the tucking means comprises, at least, a movable tucker arm assembly.

6. A device as claimed in claim 2, wherein the tucking means comprises, at least: a pair of spaced apart tucker arm assemblies.

7. A device as claimed in claim 5, wherein the tucker arm assembly has a tucker arm movable from a retracted position to a tucked position.

8. A device as claimed in claim 1, wherein the moving means comprises a fold belt drive displaced above and movingly engaging the upper platform to move the garment torso across the upper platform and a lower product conveyor movingly engaging the lower platform to move the tucked sleeve across the lower platform, the fold belt drive and the lower product conveyor respectively moving the torso and the tucked sleeve at a substantially equal moving speed.

9. A device as claimed in claim 2, wherein the moving means comprises a fold belt drive vertically displaced above and movingly engaging the upper platform to move the garment torso across the upper platform and a lower product conveyor movingly engaging the lower platform to move the tucked sleeves across the lower platform, the fold belt drive and the lower product conveyor respectively moving the torso and the tucked sleeves at a substantially equal moving speed.

10. A device as claimed in claim 7, wherein the upper platform has a longitudinal axis disposed between the infeed and discharge ends and the tucker arm is substantially parallel to the longitudinal axis from the retracted position to the tucked position.

11. A device as claimed in claim 6, wherein each tucker arm assembly has a tucker arm movable from a retracted position to a tucked position.

12. A device as claimed in claim 11, wherein the upper platform has a longitudinal axis disposed between the infeed and discharge ends and each tucker arm is substantially parallel to the longitudinal axis from the retracted position to the tucked position.

13. A device as claimed in claim 1, further comprising a front yoke assembly.

14. A device as claimed in claim 2, further comprising a front yoke assembly.

15. A device as claimed in claim 2, wherein the upper platform is so constructed to engage a portion of the torso of predefined width, thereby predefining the amount of each sleeve which is capable of being tucked between the upper and lower platforms.

16. A device as claimed in claim 1, further comprising a product blow down tube proximate the discharge end of the upper platform to direct the torso with air onto the lower platform.

17. A device as claimed in claim 2, further comprising a product blow down tube proximate the discharge end of the upper platform to direct the torso with air onto the lower platform.

18. A device for folding long sleeves of a long sleeve garment, the garment having a torso, the device comprising:

a movable lower product conveyer having a sleeve carrying portion, the lower product conveyer having a predetermined speed;

an upper platform for supporting the long sleeve garment thereon with at least one of the sleeves of the garment hanging down below the sleeve carrying portion of the lower product conveyer, the upper platform being vertically displaced above the sleeve carrying portion defining a space between the upper platform and the sleeve carrying portion;

means for tucking a hanging-down sleeve into the space; and means for continuously moving the garment across the upper platform at substantially the speed of the lower product conveyer.

19. A device as claimed in claim 18, wherein the tucking means includes means for tucking two hanging-down sleeves between the lower product conveyer and the upper platform.

20. A device as claimed in claim 18, wherein the tucking, means comprises means for simultaneously tucking the long sleeves between the lower product conveyer and the platform.

21. A device as claimed in claim 19, wherein the tucking, means comprises means for simultaneously trucking the Iona sleeves between the lower product conveyer and the platform.

22. A device as claimed in claim 18, wherein the upper platform is so constructed to engage a portion of a garment torso of predefined width, thereby predefining the amount of sleeve which is capable of being tucked between the lower product conveyer and the upper platform.

23. A device as claimed in claim 18, wherein the tucking means comprises, at least, a movable tucker arm assembly.

24. A device as claimed in claim 19, wherein the tucking, means comprises, at least: a pair of spaced apart tucker arm assemblies.

25. A device as claimed in claim 23, wherein the tucker arm assembly has a tucker arm movable from a retracted position to a tucked position.

26. A device as claimed in claim 18, wherein the moving means comprises a fold belt drive displaced above and movingly engaging the upper platform to move the garment torso across the upper platform.

27. A device as claimed in claim 26, wherein the fold belt drive and the lower product conveyor respectively move the torso and the tucked sleeve at a substantially equal moving speed.

28. A device as claimed in claim 19, wherein the moving means comprises a fold belt drive vertically displaced above and movingly engaging the upper platform to move the garment torso across the upper platform.

29. A device as claimed in claim 28, wherein the fold belt drive and the lower product conveyor respectively move the torso and the tucked sleeves at a substantially equal moving speed.

30. A device as claimed in claim 25, wherein the upper platform has a longitudinal axis disposed between the infeed and discharge ends and the tucker arm is substantially parallel to the longitudinal axis from the retracted position to the tucked position.

31. A device as claimed in claim 24, wherein each tucker arm assembly has a tucker arm movable from a retracted position to a tucked position.

32. A device as claimed in claim 31, wherein the upper platform has a longitudinal axis disposed between the infeed and discharge ends and each tucker arm is substantially parallel to the longitudinal axis from the retracted position to the tucked position.

33. A device as claimed in claim 18, further comprising a front yoke assembly.

34. A device as claimed in claim 19, further comprising a front yoke assembly.

35. A device as claimed in claim 19, wherein the upper platform is so constructed to engage a portion of the torso of predefined width, thereby predefining the amount of sleeve which is capable of being tucked between the upper and lower platforms.

36. A device as claimed in claim 18, further comprising a product blow down tube proximate the discharge end of the upper platform to direct the torso with air onto the lower platform.

37. A device as claimed in claim 19, further comprising a product blow down tube proximate the discharge end of the upper platform to direct the torso with air onto the lower platform.

38. A device for folding long sleeves of a long, sleeve garment, comprising:

a movable lower product conveyer having a sleeve carrying portion;

an upper platform being vertically displaced above the sleeve carrying portion defining a space between the upper platform and the sleeve carrying portion, the upper platform having a first side, a second side and a longitudinal axis;

a fold drive belt being vertically displaced above and movably engaging the upper platform; and at least one tucker arm being disposed adjacent one of the sides of the upper platform, the at least one tucker arm being removably insertable into the space from a retracted position to a tucked position, and the tucker arm being substantially parallel to the longitudinal axis of the upper platform from the retracted position to the tucked position.

* * * * *